US005924135A

United States Patent [19]

Worth

[11] Patent Number: 5,924,135

[45] Date of Patent: Jul. 20, 1999

[54] SKI JACKET WITH AN APERTURE IN THE WRIST AREA

[76] Inventor: Read Worth, 2660 Dick Wilson Dr., Sarasota, Fla. 34240

[21] Appl. No.: 09/097,512

[22] Filed: Jun. 15, 1998

[51] Int. Cl.[6] ..... A41D 27/10

[52] U.S. Cl. ..... 2/125; 2/59; 2/108; 2/93; 40/586

[58] Field of Search ..... 2/93, 125, 69, 2/108, 115, 59, 160, 162, 94, 158, 159, 270, 170, 85; 40/661, 660, 586

[56] References Cited

U.S. PATENT DOCUMENTS

| | | | |
|---|---|---|---|
| 296,554 | 9/1884 | Goldston | 2/59 |
| 1,227,052 | 5/1917 | Hogan | 2/59 |
| 2,103,711 | 11/1937 | Cole | 2/160 |
| 4,195,362 | 4/1980 | Rolando | 2/97 |
| 4,387,838 | 6/1983 | Jackson | 2/160 |
| 5,584,133 | 12/1996 | Motooka et al. | 2/160 |
| 5,775,011 | 7/1998 | Reitano | 36/136 |

*Primary Examiner*—John J. Calvert
*Assistant Examiner*—Tejash D Patel

[57] ABSTRACT

An item of wearing apparel for allowing the convenient viewing of a wrist watch comprising a main body portion forming a main space adapted to encompass the torso of a wearer and with two laterally disposed long sleeves for the arms of a wearer. Each sleeve has an opening at the top for communicating with the main body portion and an opening at the bottom for the wrist of a wearer. An aperture is formed in at least one of the sleeves adjacent to the bottom of the sleeve.

5 Claims, 2 Drawing Sheets

FIG 1
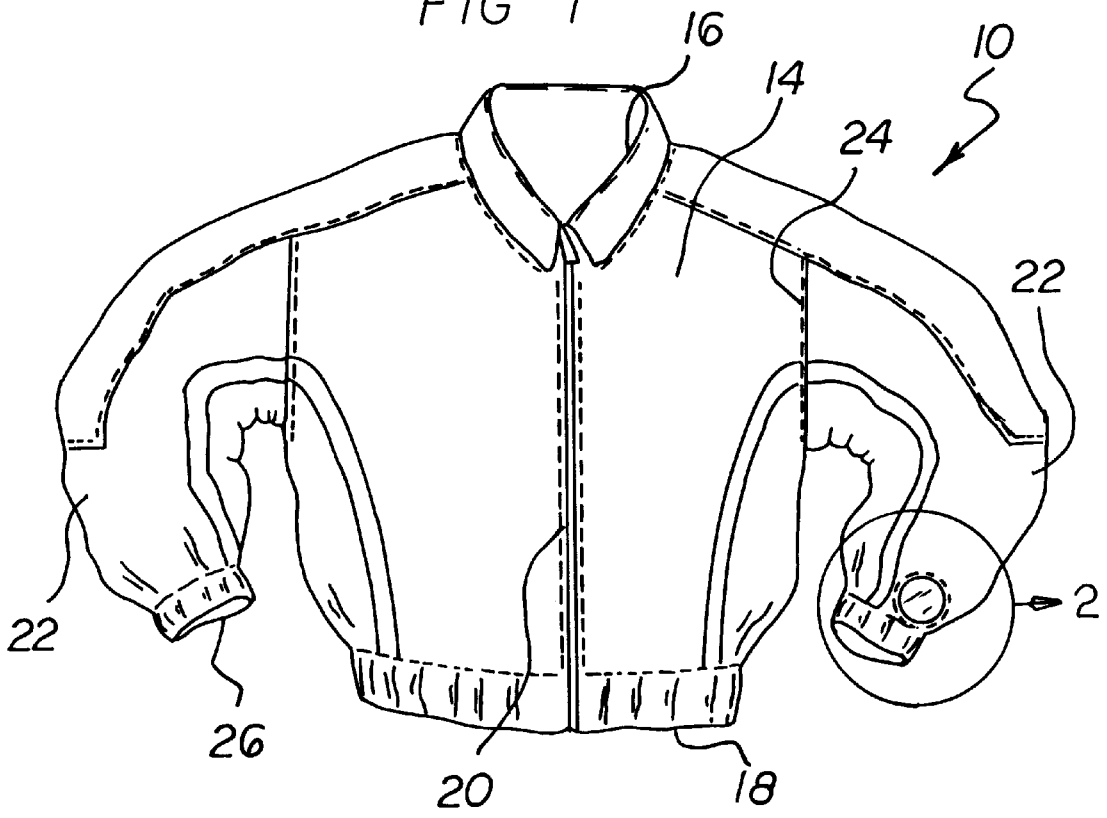
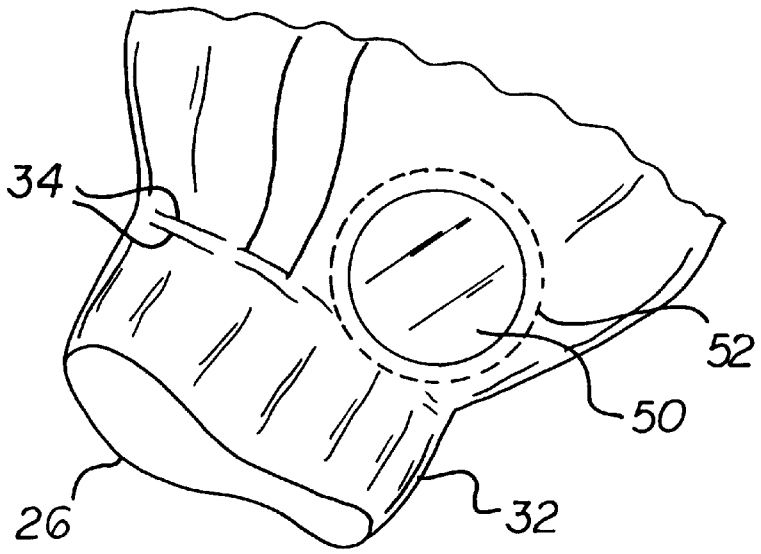
FIG 2

FIG 3
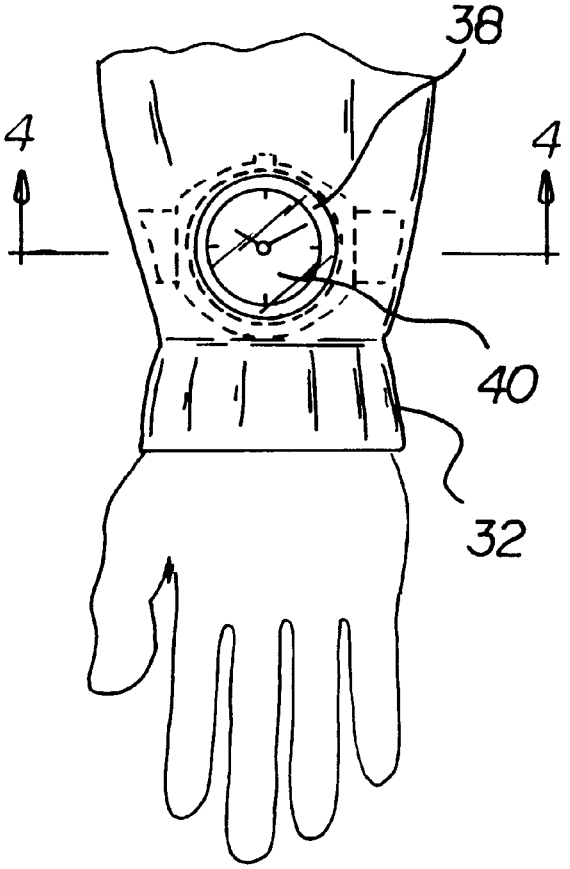
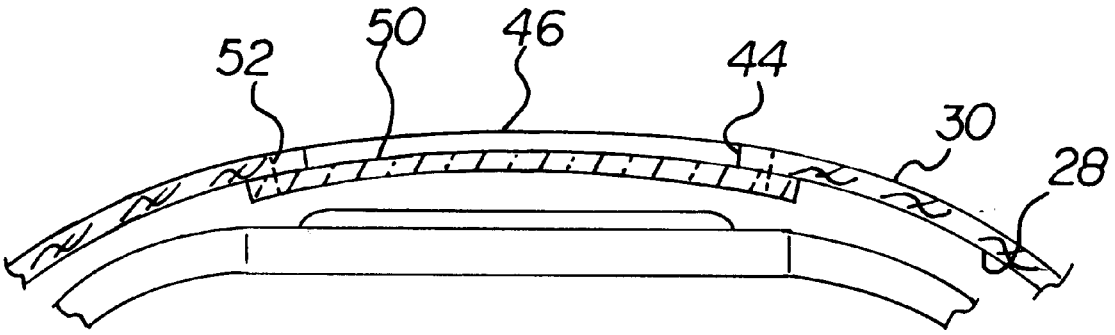
FIG 4

SKI JACKET WITH AN APERTURE IN THE WRIST AREA

BACKGROUND OF THE INVENTION

1. Field of the Invention

The present invention relates to a ski jacket with an aperture in the wrist area and more particularly pertains to allowing the wearer of a ski jacket to view a wrist watch.

2. Description of the Prior Art

The use of jackets with openings of known designs and configurations is known in the prior art. More specifically, jackets with openings of known designs and configurations heretofore devised and utilized for the purpose of extending the utility of garments through known designs and apparatuses are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,722,099 to Kratz which discloses Protective Motorcycle Garments for Maximum Cooling.

U.S. Pat. No. 5,477,633 to Leinberger which discloses a Document Holder for Wearer's Limb.

U.S. Pat. No. 5,623,731 to Ehrgott et al. which discloses a Detachable Device for Fastening an Objected, Located in a Case, to a Carrier.

Lastly, U.S. Pat. No. 5,704,067 to Brady discloses an Exercise Organizer Sweatband.

In this respect, the ski jacket with an aperture in the wrist area according to the present invention substantially departs from the conventional concepts and designs of the prior art, and in so doing provides an apparatus primarily developed for the purpose of allowing the wearer of a ski jacket to view a wrist watch.

Therefore, it can be appreciated that there exists a continuing need for a new and improved ski jacket with an aperture in the wrist area which can be used for allowing the wearer of a ski jacket to view a wrist watch. In this regard, the present invention substantially fulfills this need.

SUMMARY OF THE INVENTION

In view of the foregoing disadvantages inherent in the known types of jackets with openings of known designs and configurations now present in the prior art, the present invention provides an improved ski jacket with an aperture in the wrist area. As such, the general purpose of the present invention, which will be described subsequently in greater detail, is to provide a new and improved ski jacket with an aperture in the wrist area which has all the advantages of the prior art and none of the disadvantages.

To attain this, the present invention essentially comprises a new and improved ski jacket with an aperture in the wrist area for allowing the convenient viewing of a wrist watch. A main body portion is provided which forms a main space adapted to encompass the torso of a wearer and with a top neck opening at the top, a bottom waist opening 18 at the bottom, a closable opening in the front vertically disposed between the top opening and the bottom opening and with two laterally disposed long sleeves for the arms of a wearer. Each sleeve has an opening at the top for communicating with the main space and an opening at the bottom for the wrist of a wearer. Each sleeve has an interior face and an exterior face and terminates in a cuff with two essentially circumferential lines of stitching therearound. Also provided is a wrist watch positioned on the wrist of a wearer beneath the sleeve inboard of the cuff. The wrist watch has a face for displaying the time. A circular aperture is provided and has a first diameter formed in at least one of the sleeves inboard of the cuff to overlie the face of the wrist watch to allow the viewing of the wrist watch. Also included is a circular transparent plastic window having a secured diameter greater than the first diameter of the aperture. Lastly provided is a circular line of stitching which extends through the window and the fabric of the sleeve surrounding the aperture for the coupling therebetween. The window is located on the exterior face of the sleeve. The jacket is fabricated of a woven plastic material of a waterproof nature with the stitching adapted to preclude the unraveling of the threads of the fabric of the cuff and around the aperture.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ski jacket with an aperture in the wrist area which has all the advantages of the prior art jackets with openings of known designs and configurations and none of the disadvantages.

It is another object of the present invention to provide a new and improved ski jacket with an aperture in the wrist area which may be easily and efficiently manufactured and marketed.

It is a further object of the present invention to provide a new and improved ski jacket with an aperture in the wrist area which is of a durable and reliable construction.

An even further object of the present invention is to provide a new and improved ski jacket with an aperture in the wrist area which is susceptible of a low cost of manufacture with regard to both materials and labor, and which accordingly is then susceptible of low prices of sale to the consuming public, thereby making such a ski jacket with an aperture in the wrist area economically available to the buying public.

Still yet another object of the present invention is to provide a new and improved ski jacket with an aperture in the wrist area which provides in the apparatuses and methods of the prior art some of the advantages thereof, while simultaneously overcoming some of the disadvantages normally associated therewith.

Still another object of the present invention is to allowing the wearer of a ski jacket to view a wrist watch.

Lastly, it is an object of the present invention to provide a new and improved item of wearing apparel for allowing the convenient viewing of a wrist watch comprising a main body portion forming a main space adapted to encompass the torso of a wearer and with two laterally disposed long sleeves for the arms of a wearer. Each sleeve has an opening at the top for communicating with the main body portion and an opening at the bottom for the wrist of a wearer. An aperture os formed in at least one of the sleeves adjacent to the bottom of the sleeve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of the preferred embodiment of the ski jacket with an aperture in the wrist area constructed in accordance with the principles of the present invention.

FIG. 2 is a an enlarged elevational view of the sleeve and aperture taken at circle 2 of FIG. 1.

FIG. 3 is a perspective illustration of the sleeve area shown in the prior Figures shown on a user wearing a wrist watch.

FIG. 4 is a cross-sectional view taken along line 4—4 of FIG. 3.

Similar reference characters refer to similar parts throughout the several views of the drawings.

DESCRIPTION OF THE PREFERRED EMBODIMENT

With reference now to the drawings, and in particular to FIG. 1 thereof, a new and improved ski jacket with an aperture in the wrist area embodying the principles and concepts of the present invention and generally designated by the reference numeral 10 will be described.

The present invention, the new and improved ski jacket with an aperture in the wrist area, is comprised of a plurality of components. Such components in their broadest context include main body portion, a top opening and a bottom opening. Such components are individually configured and correlated with respect to each other so as to attain the desired objective.

More specifically, it will be noted that the new and improved ski jacket with an aperture in the wrist area for allowing the convenient viewing of a wrist watch comprises, in combination a main body portion 14 which forms a main space adapted to encompass the torso of a wearer and with a top neck opening 16 at the top, a bottom waist opening 18 at the bottom. a closable opening 20 is in the front vertically disposed between the top opening and the bottom opening and with two laterally disposed long sleeves 22 for the arms of a wearer. Each sleeve has an opening 24 at the top for communicating with the main space and an opening 26 at the bottom for the wrist of a wearer. Each sleeve has an interior face 28 and an exterior face 30 and terminates in a cuff 32 with two essentially circumferential lines of stitching 34 therearound.

Also provided is a wrist watch 38 positioned on the wrist of a wearer beneath the sleeve inboard of the cuff. The wrist watch has a face 40 for displaying the time.

A circular aperture 44 is provided and has a first diameter 46 formed in at least one of the sleeves inboard of the cuff to overlie the face of the wrist watch to allow the viewing of the wrist watch. The circular configuration in combination with its location above the cuff allows for improved viewing of the watch for telling time.

Also included is a circular transparent plastic window 50 having a secured diameter greater than the first diameter of the aperture.

Lastly provided is a circular line of stitching 52 extending through the window and the fabric of the sleeve surrounding the aperture for the coupling therebetween. The window is located on the exterior face of the sleeve. The jacket is fabricated of a woven plastic material of a waterproof nature with the stitching adapted to preclude the unraveling of the threads of the fabric of the cuff and around the aperture.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ski jacket with an aperture in the wrist area for allowing the convenient viewing of a wrist watch comprising, in combination:

a main body portion forming a main space adapted to encompass the torso of a wearer and with a top neck opening at the top, a bottom waist opening at the bottom, a closable opening in the front vertically disposed between the top opening and the bottom opening and with two laterally disposed long sleeves for the arms of a wearer, each sleeve having an opening at the top for communicating with the main space and with an opening at the bottom for the wrist of a wearer, each sleeve having an interior face and an exterior face and terminating in a cuff with two essentially circumferential lines of stitching therearound;

a wrist watch positioned on the wrist of a wearer beneath the sleeve inboard of the cuff, the wrist watch having a face for displaying the time;

a circular aperture having a first diameter formed in at least one of the sleeves inboard of the cuff to overlie the face of the wrist watch to allow the viewing of the wrist watch;

a circular transparent plastic window having a secured diameter greater than the first diameter of the aperture; and a circular line of stitching extending through the window and the fabric of the sleeve surrounding the aperture for the coupling therebetween, the window being located on the exterior face of the sleeve, the jacket being fabricated of a woven plastic material of a waterproof nature with the stitching adapted to preclude the unraveling of the threads of the fabric of the cuff and around the aperture.

2. An item of wearing apparel for allowing the convenient viewing of a wrist watch comprising;

a main body portion forming a main space adapted to encompass the torso of a wearer and with two laterally disposed long sleeves for the arms of a wearer, each sleeve having an opening at the top for communicating with the main body portion and an opening at the bottom with a cuff for the wrist of a wearer; and a circular aperture formed in at least one of the sleeves adjacent to the bottom of the sleeve and above the cuff, the aperture extending entirely through the sleeve for viewing of a wristwatch worn on a wearer's wrist independent of the sleeve.

3. The apparel as disclosed in claim 2 and further comprising a wrist watch positionable on the wrist of a wearer beneath the sleeve inboard of the cuff, the wrist watch having a face with a dial for displaying the time.

4. The apparel as disclosed in claim 2 and further comprising a transparent window having a diameter greater than the diameter of the aperture.

5. The apparel as disclosed in therefor claim 4 and further comprising a line of stitching surrounding the aperture and through the window for the coupling therebetween, the window being located on the interior face of the sleeve, the jacket being fabricated of a woven plastic material of a waterproof nature with the stitching adapted to preclude the unraveling of the threads of the fabric of the cuff and around the aperture.

* * * * *